US005337491A

United States Patent [19]

Mascotte

[11] Patent Number: 5,337,491

[45] Date of Patent: Aug. 16, 1994

[54] SHOE COVERING MEMBERS

[76] Inventor: Lawrence L. Mascotte, 9106 SE. 82nd, Portland, Oreg. 97266

[21] Appl. No.: 63,725

[22] Filed: May 20, 1993

[51] Int. Cl.[5] ..... A43B 3/16

[52] U.S. Cl. ..... 36/7.1 R; 36/72 R

[58] Field of Search ..... 36/7.1 R, 72 R, 1.5, 36/2 R, 101, 7.2, 100, 15

[56] References Cited

U.S. PATENT DOCUMENTS

| | | | |
|---|---|---|---|
| 1,090,223 | 3/1914 | McNeer | 36/1.5 |
| 1,341,323 | 5/1920 | Jessup | 36/15 |
| 2,097,200 | 10/1937 | Menutole | 36/1.5 |
| 2,099,476 | 11/1937 | Glowka | 36/2 R |
| 2,235,490 | 3/1941 | Saksa | 36/1.5 |
| 2,368,314 | 1/1945 | Marx | 36/101 |
| 3,744,158 | 7/1973 | Walker | 36/1.5 |
| 4,713,895 | 12/1987 | Vallieres | 36/2 R |
| 5,144,759 | 9/1992 | Mascotte | 36/7.1 R |

FOREIGN PATENT DOCUMENTS

| | | | |
|---|---|---|---|
| 636475 | 4/1928 | France | 36/2 R |

*Primary Examiner*—Steven N. Meyers
*Attorney, Agent, or Firm*—Adrian J. LaRue

[57] ABSTRACT

A shoe covering member comprises a covering member having a shape conforming to an upper section of a shoe over which it is to cover. A bottom section of the covering member is sealingly engaged with a sole of the shoe and the covering member is provided with a fold at its rear end which is fastened in a folded condition to snugly engage the upper section of the shoe. A projection extends along a side surface of the shoe sole adjacent sealing engagement of the bottom section of the covering member with the sole to protect such engagement.

6 Claims, 1 Drawing Sheet

SHOE COVERING MEMBERS

FIELD OF THE INVENTION

This invention relates to covering members and more particularly to covering members for shoes including means to protect the securing members for securing the covering members to the shoe soles to prevent the covering members form being disconnected from the soles.

BACKGROUND OF THE INVENTION

A shoe-covering member is disclosed in U.S. Pat. No. 5,144,759 wherein the shoe-covering member in the form of an upper member covers the upper member of an existing shoe, such as a walking or jogging shoe or for use as a bicycle shoe. The side surface of the sole of the shoe and the bottom end of the covering member are provided with securing members for securing the bottom end of the covering member to and along the shoe sole. Means are provided on the covering member for snugly fitting the covering member onto the upper member of the shoe and the ankle or leg above the upper member. The covering member is preferably made of a material that breathes but keeps water from passing therethrough.

The cover member can become disconnected from the sole when the shoe engages something like a rock, a tree, a curb or other items. Water could readily enter the shoe where the covering member has become disconnected from the shoe thereby defeating the purpose of the shoe-covering member, i.e., to keep water from wetting the shoe during rainy or wet conditions.

An important object of the present invention is to provide a means for protecting the securing member of the shoe-covering member and the shoe sole thereby preventing the covering member from being disconnected from the sole.

SUMMARY OF THE INVENTION

A shoe-covering member for covering an upper section of a shoe and for sealing engagement with a sealing member extending entirely along a side surface of a sole section of the shoe, the side surface of the sole section includes a projection adjacent the sealing member that protects the matable sealing members of the shoe-covering member and the sole section thereby preventing the shoe-covering member from being disconnected from the sole section.

BRIEF DESCRIPTION OF THE DRAWINGS

The invention, together with objects and advantages thereof, is best understood by way of example by reference to the following detailed description in conjunction with the accompanying drawing.

DETAILED DESCRIPTION OF THE INVENTION

Figure 1:
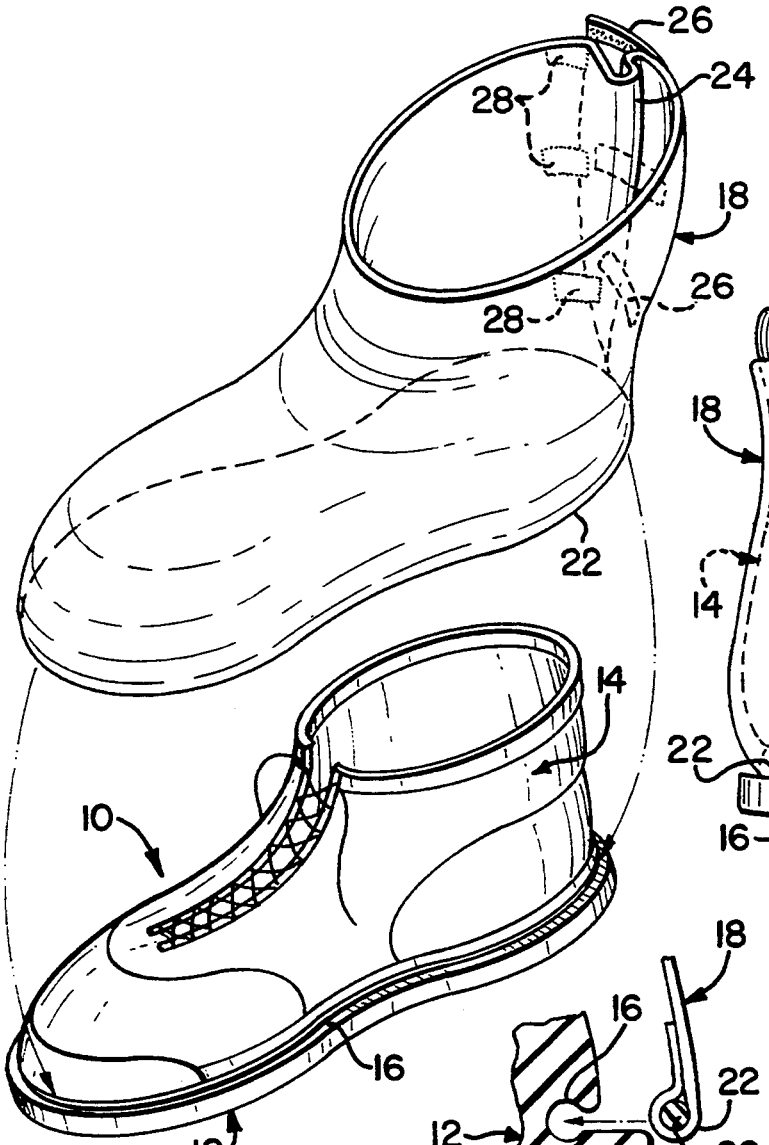
FIG. 1 is an exploded perspective view of a shoe and show covering member.

As shown in FIGS. 1–4, a conventional shoe 10 is of the type that is normally referred to as walking, jogging or athletic shoes which include a sole 12 and an upper section 14.

Sole 12 is molded from a suitable rubber or rubber-like material and is affixed to upper section 14 in accordance with conventional shoe-making practices. Sole 12 has an arcuate groove or recess 16 formed therein during the molding process and it extends along the entire side surface of sole 12. As can be seen from FIG. 3, recess 16 is about three quarters of a circle.

As shown more particularly in FIGS. 3 and 4, sole 12 below recess 16 has a projection **12*p* that extends outwardly and entirely along the side surface of sole 12**.

Upper section 14 can be made from leather or synthetic, which is otherwise known as man-made material, or a combination of leather and synthetic material. Moisture, as a result of rain, can cause upper sections 14 of the shoes to get wet when the shoes are worn when walking, jogging, riding a bicycle or other activity during the time rain is falling or when the ground, roadway or walkway is wet. The wet shoes add weight, especially during walking and jogging, and cause the feet to be uncomfortable which detracts from the activity in which the person is involved.

Figure 2:
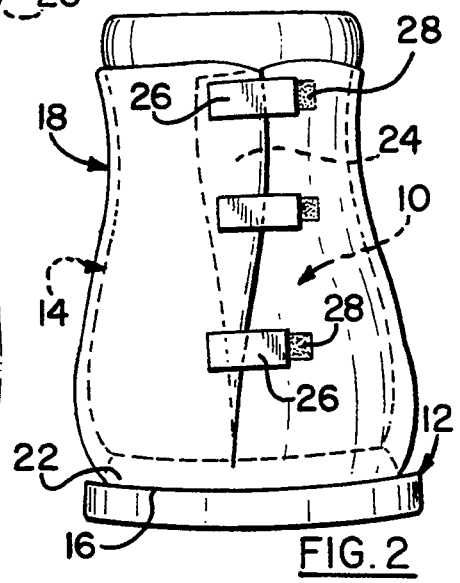
FIG. 2 is a rear elevational view, showing the covering member on the shoe.

In order to prevent the shoes from getting wet, shoe covering members 18 cover upper sections 14 and have their bottom ends sealingly connected to the soles 12 of shoes 10. Each shoe covering member 18 is in the form of an upper section of a shoe as shown in FIGS. 1 and 2 and is made from a suitable material to prevent water from passing therethrough. A preferable material is one that is breathable whereby air molecules can pass through the material but water molecules cannot thereby enabling the feet to breathe without becoming wet from the rain water. The material is lightweight and does not add undue weight to the shoes when the covering members are place thereover. The shoe covering members can thus be easily carried and installed onto the shoes when needed.

Figure 3:
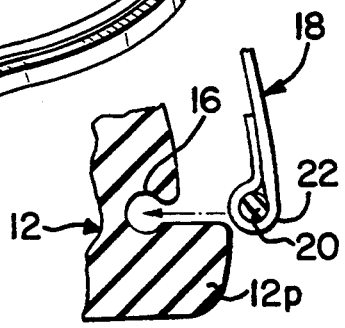
FIGS. 3 and 4 are part cross-sectional views of the shoe sole and bottom section of the covering member showing the securing of the bottom section in the sole.
Figure 4:
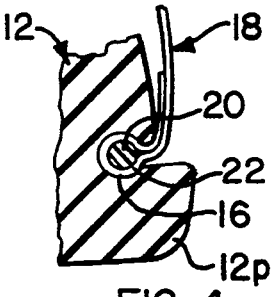

An O-ring member 20, which is made from a suitable elastic material, is secured in an overlapped bottom end 22 of covering member 18 shown in FIGS. 3 and 4. The O-ring 20 and overlapped end 22 of covering member 18 are forcefully pushed into recess 16 in sole 12 of shoe 10 thereby sealingly securing covering member 18 onto sole 12 while the upper part of covering member 18 covers upper section 14 of shoe 10.

O-ring 20 is of a size so that it can be used in a range of sizes of shoes due to its elasticity. The same is true of the material of covering member 18. Overlapped bottom end 22 is secured in place by an adhesive or by other conventional means.

When O-ring 20 and overlapped end 22 of covering member 18 are forcefully pushed into and connected within recess 16 in sole 12, projection **12*p* protects this connection from becoming disconnected when the sole hits against a stone, curb or other object that may cause such disconnection thereby maintaining the covering member 18** in position along the sole.

In order for covering member 18 to be snugly engaged with upper section 14 of shoe 10, a fold 24 is located along the back or rear section of covering member 18, as shown in FIGS. 1 and 2, and it forms a triangle when it is folded. Sections 26, 28 of fastening members sold under the VELCRO trademark are provided along fold 24 to form the V-shaped fold when they are in engagement thereby causing covering member 18 to snugly engage upper section 14 of shoe 10 as shown in FIG. 2. As can be discerned, the apex of triangular-shaped fold 24 is adjacent overlapped end 22 whereas the base is at the top section of covering member 18. Other types of fastening devices can of course be used if desired.

The top section of covering member 18 can extend above upper section 14 of shoe 10 and engage the leg of the person if desired.

Figure 5:
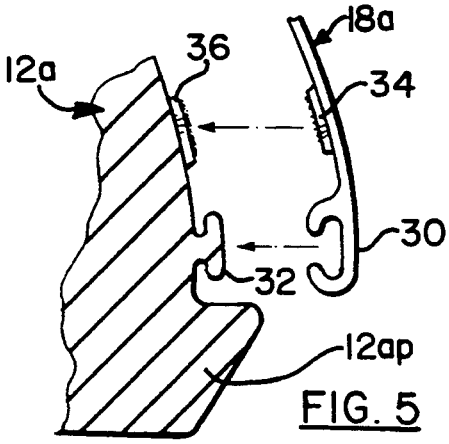
FIGS. 5 and 6 are views similar to FIGS. 3 and 4 showing an alternative embodiment for the securing of the bottom section of the covering member to the shoe sole.
Figure 6:
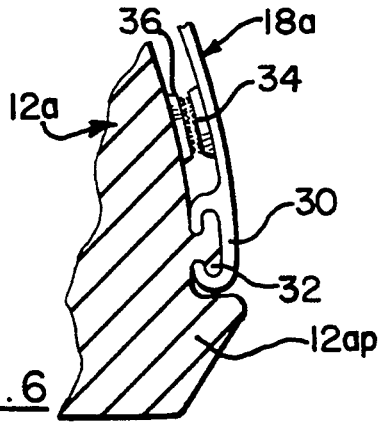

FIGS. 5 and 6 show alternative structure for securing the bottom section of covering member 18*a* to sole 12*a*. Covering member 18*a* has a C-shaped member 30 at its bottom section which is sealingly matable onto an oblong projection 32 disposed along the side surface of sole 12*a*. If desired, VELCRO fastening members 34, 36 can be disposed respectively along an inside surface of covering member 18*a* above C-shaped member 30 and along the side surface of sole 12*a* above oblong projection 32 to assure that member 30 is maintained onto projection 32. Fastening members 34, 36 can be located at spaced locations instead of extending completely along covering member 18*a* and sole 12*a*.

Sole 12*a* also has a projection 12*ap* extending outwardly from the side surface adjacent oblong projection 32 and protects the connection of C-shaped member 30 onto oblong projection 32 in the same manner as projection 12*a* of sole 12. Projection 12*ap* can have a sloped side surface, if desired, which can also be the same with regard to projection 12*p* of sole 12.

To place covering member 18 onto shoe 10, fold 24 is unfolded and the toe of the shoe on a person's foot is inserted through the top section of the covering member and it is pulled onto the shoe. Thereafter, overlapped end 22 and O-ring 20 are pushed into recess 16 and fastening members 26, 28 fastened together whereby covering member 18 is sealingly and snugly positioned onto shoe 10. In the case of covering member 18*a*, C-shaped member 30 is snapped onto oblong projection 32 and fastening members 34,36 are engaged.

As can be discerned, a lightweight and waterproof covering member for covering shoes has been disclosed which is sealingly connected to soles of the shoes and snugly engaged with upper sections thereof with the soles having a means to protect the connection of the covering member to the soles.

What is claimed is:

1. A shoe and a shoe-covering member therefor, comprising:

a shoe having a sole section and an upper section, said sole section having a sealing member extending entirely along a side surface thereof;

a covering member of a water-impermeable material having a shape conforming to the upper section of said shoe and being positionable thereover;

a matable sealing member extending entirely along a bottom end of said covering member and being matably and sealingly engageable with said sealing member of said sole section of said shoe to prevent water from passing through the mated sealing members to the upper section of the shoe;

a projection extending outwardly and entirely along said side surface of said sole section adjacent said sealing member for protecting the matable engagement between the sealing member and the matable sealing member; and means on said covering member for snugly maintaining the covering member in engagement with the upper section of the shoe.

2. A shoe and shoe-covering member as claimed in claim 1, wherein the snugly-maintaining means comprises a fold at a back end of said covering member which has a V-shaped configuration when folded, and fastening means on said covering member for maintaining the V-shaped fold in the folded condition.

3. A shoe and a shoe-covering member therefor as claimed in claim 1, wherein the sealing member along the side surface of the sole section comprises a recess and the matable sealing member includes an overlapped bottom section of said covering member in which an elastic O-ring is secured, the overlapped bottom section with the O-ring therein being insertable in said recess.

4. A shoe and a shoe-covering member therefor as claimed in claim 1, wherein the sealing member along the side surface of the sole section comprises an oblong projection and the matable sealing member includes a C-shaped member being pressed onto said oblong projection.

5. A shoe and shoe-covering member therefor as claimed in claim 4, wherein fastening means are located on an inside surface of said covering member above said C-shaped member for fastening engagement with matable fastening means along the side surface of the sole section above said oblong projection.

6. A shoe and shoe-covering member therefore as claimed in claim 1, wherein a side surface of said projection is sloped.

* * * * *